US008276335B2

(12) United States Patent
Waibel

(10) Patent No.: US 8,276,335 B2
(45) Date of Patent: Oct. 2, 2012

(54) ATTACHMENT PROFILE

(75) Inventor: Martin Waibel, Gaggenau (DE)

(73) Assignee: Protektorwerk Florenz Maisch GmbH & Co. KG, Gaggenau (DE)

( * ) Notice: Subject to any disclaimer, the term of this patent is extended or adjusted under 35 U.S.C. 154(b) by 39 days.

(21) Appl. No.: 12/661,792

(22) Filed: Mar. 24, 2010

(65) Prior Publication Data

US 2010/0269436 A1 Oct. 28, 2010

(30) Foreign Application Priority Data

Apr. 23, 2009 (DE) ..... 20 2009 004 731 U
Jul. 17, 2009 (EP) ..... 09009325

(51) Int. Cl.
*E04B 2/00* (2006.01)
*E04C 3/00* (2006.01)

(52) U.S. Cl. ..... 52/241; 52/481.2; 52/846; 52/745.09

(58) Field of Classification Search ..... 52/85, 241, 52/245, 247, 481.2, 717.03, 745.09, 846
See application file for complete search history.

(56) References Cited

U.S. PATENT DOCUMENTS 5,291,717 A * 3/1994 Turner ..... 52/745.07
5,671,583 A * 9/1997 Turner ..... 52/745.16
5,816,002 A * 10/1998 Bifano et al. ..... 52/255
6,094,877 A * 8/2000 White ..... 52/247
6,115,984 A * 9/2000 Paradis ..... 52/717.03
6,237,301 B1 * 5/2001 Paradis ..... 52/717.03
6,434,908 B1 * 8/2002 Ferrante ..... 52/481.2
6,655,100 B1 * 12/2003 Andino ..... 52/247
7,293,392 B2 * 11/2007 Krumbacher ..... 52/241
7,458,188 B2 * 12/2008 Mears ..... 52/300
2005/0086896 A1 * 4/2005 Krumbacher ..... 52/633
2005/0115192 A1 * 6/2005 Stone et al. ..... 52/720.1
2006/0010789 A1 * 1/2006 Andino ..... 52/85
2006/0096663 A1 * 5/2006 Edlund ..... 144/4.2

FOREIGN PATENT DOCUMENTS

DE 20 2006 004 085.4 6/2006

* cited by examiner

*Primary Examiner* — Robert Canfield

(74) *Attorney, Agent, or Firm* — Collard & Roe, P.C.

(57) ABSTRACT

In the construction of walls in balloon framing below roof pitches, the attachment profiles need to be suitable for different inclines and are to be connectable to the incline. For this purpose, the attachment profiles have fastening tabs on both sides, which may be bent into the particular required inclined attitude. The fastening tabs extend nearly over the entire profile web and are only linked on a deflection edge on one side on the attachment profile in the area of the profile web. In addition, the attachment profile can be used for the upper and lower fixing of the sub profiles of a stud or stud round wall.

7 Claims, 2 Drawing Sheets

ATTACHMENT PROFILE

CROSS REFERENCE TO RELATED APPLICATIONS

Applicant claims priority under 35 U.S.C. §119 of German Application No. 20 2009 004 731 filed on Apr. 23, 2009 and European Application No. 09009325 filed on Jul. 17, 2009.

BACKGROUND OF THE INVENTION

1. Field of the Invention

The invention relates to an attachment profile for terminating a wall erected in balloon framing, in particular a knee wall or a round wall, which can be placed on the upper and/or lower front sides of the at least approximately vertically erected stud profiles of the wall. The attachment profile has two side webs, which are spaced apart from one another by the width of a profile web, and are connected to one another by the profile web, and combine to form a U-shape. The profile web is notched in such a manner that the fastening tabs are cut out of the profile web so as to be pivotable around the deflection edge, which connects the side web to the fastening web in each case.

2. The Prior Art

Such an attachment profile is described in German Utility Model DE 20 2006 004 085.4. The previously known attachment profile also relates to the problems of having to connect U-profiles to erect a stud wall produced in dry mortarless construction or a wall having to be connected to the floor and the ceiling of a structure and having to be braced and fastened predominantly in the horizontal direction of the situated attachment profile for this purpose. These stud profiles are preferably CW profiles, whose name originates from the C-shape of the stud profiles in question. These profiles are then planked on one or both sides—optionally with thermal insulation, a noise barrier, or corresponding installation levels interposed. Plasterboard or chipboard slabs come into consideration as typical planking.

In a similar way to the internal structure, external walls may also be produced in metal or wood balloon frame construction and planked accordingly.

A knee wall is understood as the vertical wall between the load-bearing roof structure, i.e., typically the wooden truss and the uppermost story ceiling, i.e., essentially the extension of the house exterior wall upward and below the roof. Depending on the roof pitch and degree of extension, this wall may be implemented having different heights. In many cases, the knee wall is only implemented knee-high, hence the term "knee wall".

In a design of this type, the problem exists of how the upper attachment profile, which is predominantly implemented as a U or L profile, is to be connected on one side to the vertically erected stud profiles and on the other side to the typically diagonally aligned roof truss, so that the stud wall erected in dry mortarless construction is reliably fixed in this way.

This problem is solved according to DE 20 2006 004 085.4 in that an attachment profile, which was predominantly developed as U-shaped, has two side webs, which are connected to one another by a common profile web. Fastening tabs are incorporated in the profile web on both sides, which may each be bent over around their particular linkage edge, so that it is possible, using these fastening tabs, to set an angle corresponding to the roof truss, fasten the attachment web to the roof truss, and simultaneously connect the two side webs as intended to the vertically erected stud profiles.

The design of the previously known attachment profile was based on the idea of incorporating the fastening tabs on both sides into the profile web, so that the same attachment profile for fastening on a roof truss running on the left of the attachment profile or if needed a roof truss running on the right can be fastened in that either the fastening tabs situated on the left or the fastening tabs situated on the right on the attachment profile are used for fastening.

However, practice has shown that the design, because of the fastening tabs incorporated on both sides of the profile web, may lack the intrinsic strength which is sometimes needed for securing the stud walls.

Moreover, the questionable design could only be used in connection with linear stud walls, i.e., not in connection with round walls or other curved walls or wall sections, for example.

SUMMARY OF THE INVENTION

Proceeding from this problem, it is an object of the present invention to provide an improved attachment profile for a wall erected in dry mortarless construction, which fundamentally avoids the described disadvantages of the prior art and opens up further applications.

Proceeding from the described prior art, the present invention provides for cutting the fastening tabs out of the profile web so that they are only linked so they are pivotable on the same deflection edge of the particular attachment profile. The fastening tabs are thus not implemented on both sides of the profile web, but rather only on one side of the profile web.

The problems of using the attachment profile for both left-side and also right-side fastening in the roof truss or another roof substructure can be solved easily in that the corresponding attachment profile, at least after it has been cut to the desired length on location, can be turned over so that the fastening tabs are situated on the left side are situated on the right side after a 180° rotation around the longitudinal side of the attachment profile.

Because of this surprisingly simple solution, a constructively simple solution and an attachment profile are provided, which has a higher intrinsic rigidity as a result of the reduced number of the fastening tabs incorporated in the profile web than the previously known design described above.

In an advantageous embodiment of this solution, the cutouts of the fastening tabs from the profile web are each implemented so that the cut edges delimiting the fastening tabs are at least sectionally spaced apart from the particular adjoining profile web far enough that the fastening tabs can be pivoted around the particular deflection edge easily on location, in order to set the particular desired adjustment angle of the particular fastening tabs easily.

The width of the slots is selected so that typical radii of curvature—for example, for implementing a stud round wall—may be implemented, but, on the other hand, the required intrinsic rigidity of the attachment profile is preserved.

In a further advantageous refinement, a further cutout is incorporated at least approximately at a right angle to the longitudinal extension of the attachment profile in the area of at least a part of the fastening tabs of an attachment profile in such a manner that this cutout extends up to the particular opposing other deflection edge of the attachment profile.

Because of this constructive embodiment, a cutout which overlaps the entire profile web in each case in this area is thus located in the area of these fastening tabs, with the advantageous result that if an additional cut which completely cuts through the side web in this area is introduced into the side web opposite to the fastening tabs using tin snips in imaginary extension of the further cutout, the attachment profile can be bent over easily in this area. The cut can be executed as needed on location using typical tin snips or electric cutting shears.

If one introduces cuts of this type in the area of multiple adjacent fastening tabs, radii may be applied to the attachment profile in this area as needed easily on location, i.e., at the construction site during the installation. The particular external radius runs along the side web, in which the additional notches are introduced on location. An advantageous possibility is thus provided of also using the attachment profile according to the invention for bracing in radii settable on location, i.e., in connection with the implementation of round walls or other curved wall sections.

In a further advantageous embodiment of the invention, the further cutout incorporated in the profile web, which protrudes beyond the other deflection edge opposite to the fastening tab, is led into the particular adjoining side web. A defined starting point for the notch described above into the particular side web results in this way.

Depending on the embodiment of the cutout engaging in the particular side web, the additional notch still to be introduced manually on location into the side web can be implemented as correspondingly longer or shorter. The previously described design thus represents a further aid for the installation of the attachment profile according to the invention on location, in particular its adaptation to the particular local conditions, in particular in connection with the bracing of the stud profiles for implementing a round wall.

In an advantageous refinement of the attachment profiles according to the invention, both the fastening tabs and also selected areas of the profile web are to be provided with additional fastening holes, in order to fasten the attachment profile as intended without problems to a roof substructure, such as a roof truss, or to an erection base for a stud wall.

The attachment profiles according to the invention may be produced in manufacturing technology by a single stamping-shaping stroke from a flat strip.

The above-mentioned attachment profiles may therefore be industrially manufactured from a corrosion-protected steel plate or plastic, predominantly in a cold-rolling method, depending on the application.

In a preferred use of the attachment profile according to the invention, a stud round wall can be implemented easily in that a lower attachment profile is fastened on the erection base along the desired wall course, subsequently also an upper attachment profile is fixed at an incline in the explained way, for example, and subsequently the required stud profiles are inserted into the U-profile of the lower and upper attachment profiles and also fixed therein. The stud round wall can then be planked as intended.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
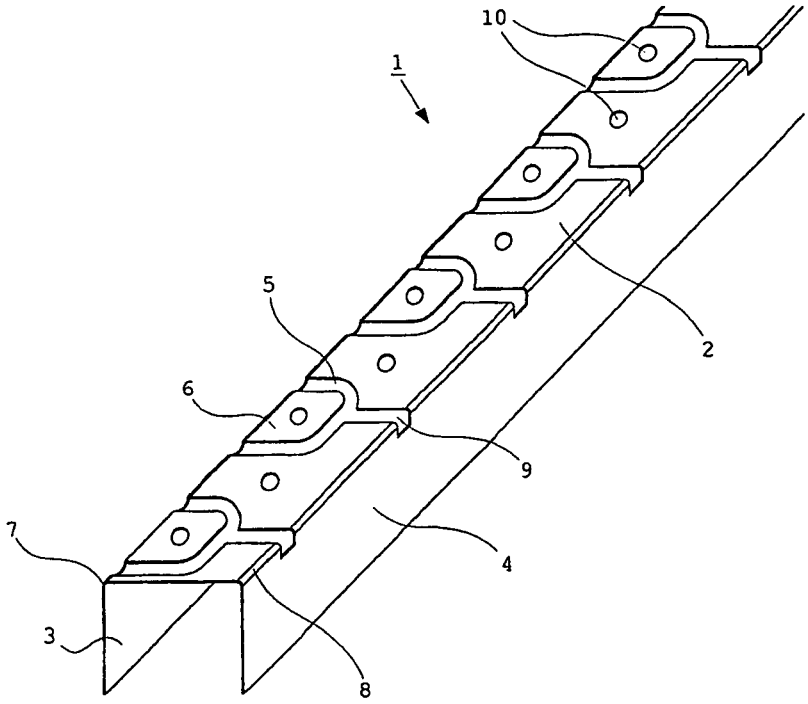
FIG. 1 shows an attachment profile in a perspective illustration.

Referring now in detail to the drawings, FIG. 1 shows an attachment profile 1 in a perspective illustration, as is used to be connected in an approximately horizontal orientation to the studs, which are situated in an approximately vertical orientation, of a stud wall produced in dry mortarless construction on one side and two inclines (not shown in greater detail here) of a ceiling or roof structure on the other side.

Attachment profile 1 has an at least extensively U-shaped cross-section, which is formed by a profile web 2 and two side webs 3, 4, which are connected to one another by profile web 2. Fastening tabs 6 are cut out of profile web 2 by corresponding notches 5. Fastening tabs 6 are only situated on one side of attachment profile 1.

Fastening tabs 6 are thus all linked around the same one deflection edge 7, which is connected to one side web 3 and profile web 2. Notches 5 are supplemented with further cutouts 9 extending up to the opposing other deflection edge 8 to form fastening tabs 6 from profile web 2. In addition, fastening holes 10 are incorporated in both fastening tabs 6 and also in profile web 2 for the fastening of attachment profile 1 in the roof structure (not shown in greater detail here) as needed.

Notches 5 and further cutouts 9 and fastening holes 10 may be incorporated into attachment profile 1 using a single stamp stroke and the essentially U-shaped profile can fundamentally be produced from a flat strip in the same stroke.

Figure 2:
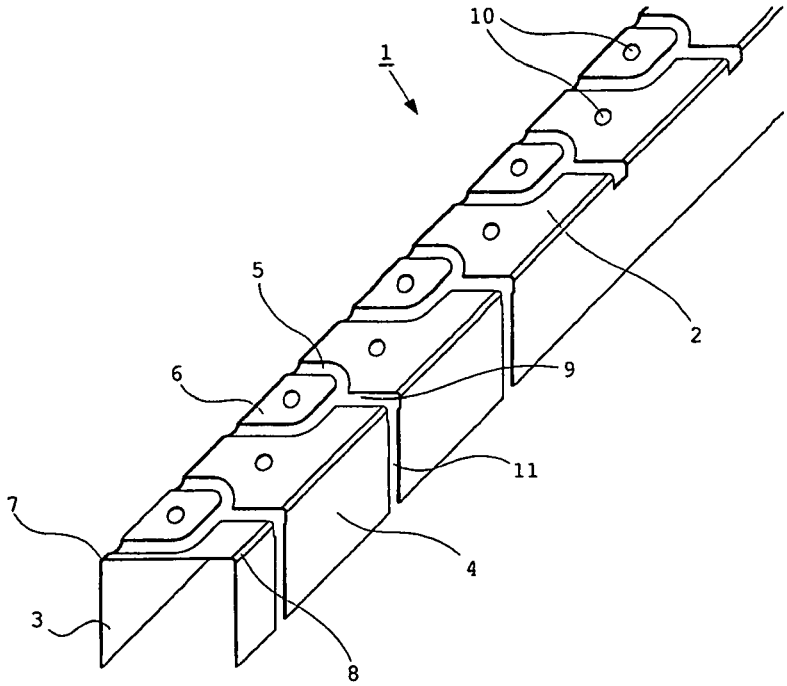
FIG. 2 shows the attachment profile shown in FIG. 1 with supplementary notches in a side web of the attachment profile.

According to the illustration in FIG. 2, further cutouts 9 according to the illustration in FIG. 1 can be led up into the other side web 4 via the other deflection edge 8 and supplemented as needed on location by corresponding additional notches 11, for example, using typical electric cutting shears or tin snips.

Further notches 11 are implemented as intended so that they cut through the entire other side web 4 in this area in connection with further cutouts 9.

The overlap of further cutouts 9 in other side web 4 is used as a positioning aid for further notches 11 and additionally ensures that notches 11 are introduced into the attachment profile 1 at the particular advisable point.

After the corresponding notches 11 have been introduced as needed on location, it is possible to bend attachment profile 1, due to the weakening in the area of the other side web 4 occurring in this way, into the particular desired radius in such a manner that one side web 3 describes a predetermined inner radius and the other side web 4 describes a predetermined outer radius of attachment profile 1, so that attachment profile 1 is also suitable for the construction of a curved wall, i.e., a round wall profile in balloon framing construction, or another curved wall section. For this purpose, attachment profile 1 can firstly be fastened on the erection base corresponding to the curved course of the stud wall using fastening tabs 6. The studs, preferably CW profiles, of the stud round wall are inserted into this U-shaped profile corresponding to the support thickness and wall shape and engaged with attachment profile 1.

Finally, a further upper attachment profile 1, which is also pre-bent corresponding to the wall course, is connected via the pivotable fastening tabs 6 to an incline, another ceiling, or the ceiling structure. For this purpose, fastening tabs 6 are simply screwed or nailed onto the ceiling or ceiling structure and subsequently attachment profile 1 is pivoted as a whole around deflection edge 7 of fastening tabs 6 fixed in this manner into the intended position. Subsequently, the stud profiles are erected at least essentially vertically as intended and engaged in the area of their frontal ends in each case to the U-profiles, which are open at the top and bottom, of the particular participating lower and upper attachment profiles.

Figure 3:
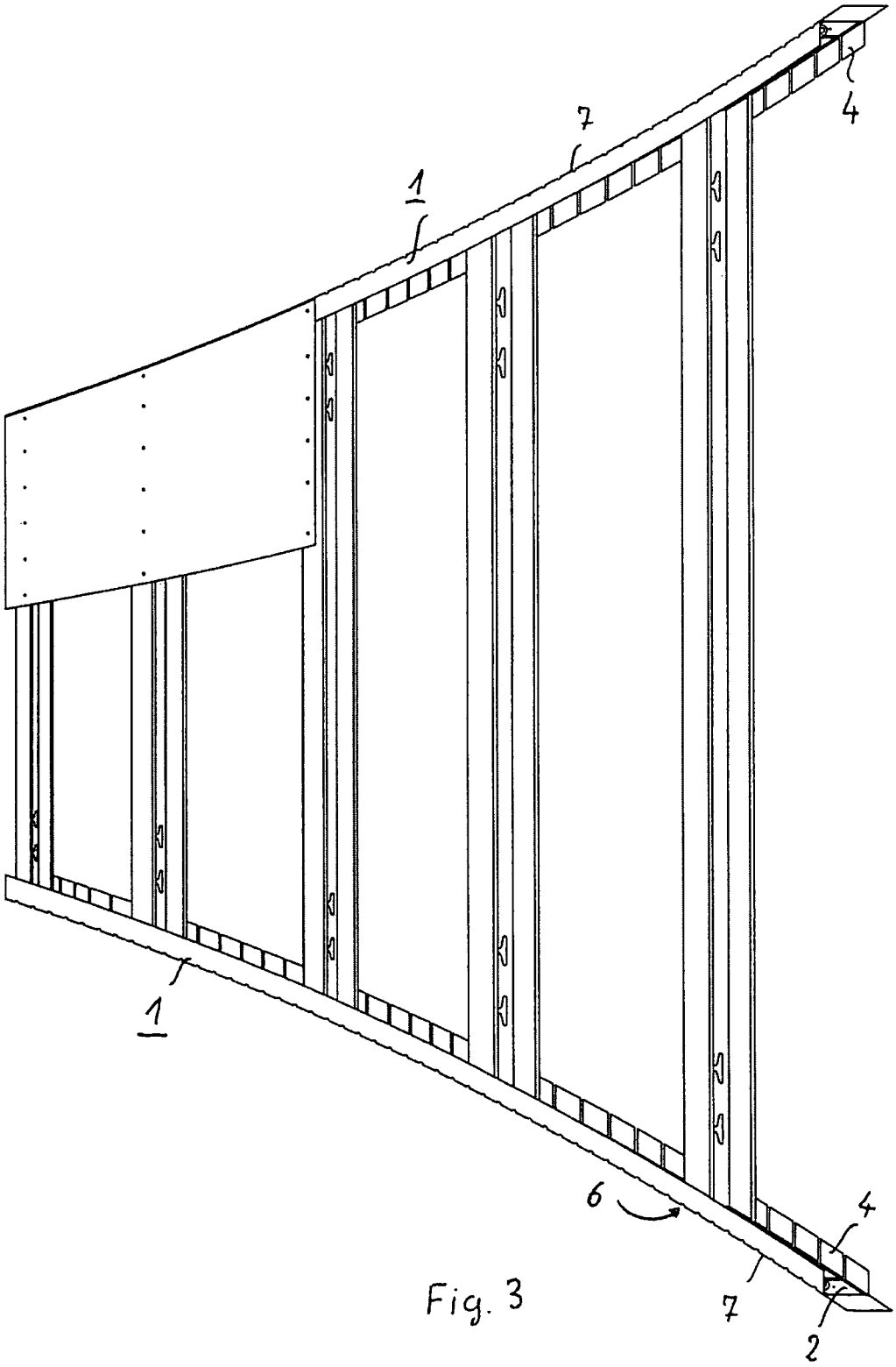
FIG. 3 shows a stud round wall built up with an attachment profile according to the invention.

As shown in FIG. 3, a stud round wall structure is thus constructed easily and simply.

As a result, it is thus possible, through a few notches to be introduced as needed on location using typical tin snips or electric cutting shears, to implement the attachment profile 1 according to the invention so that it is also suitable for fastening the stud profiles of the round wall.

As a result, the attachment profile described above can be used as intended for the purpose of connecting the stud profiles required for erecting a stud wall to an incline, another ceiling, a roof structure, or a roof substructure in that at least several fastening tabs 6 are fastened on the roof structure and subsequently the attachment profile 1 is bent as a whole around the particular deflection edge 7 so that it is in a position adapted to the particular roof pitch.

In addition, the same attachment profile can be used for linear stud walls and also for round walls and can be adapted on location to the particular conditions using the simplest aids.

This has advantages both for manufacturing, because different applications may be handled using the same profile, but also on location at the construction site, because only one attachment profile type must be kept ready in order to deal with different construction requirements.

Accordingly, while only a few embodiments of the present invention have been shown and described, it is obvious that many changes and modifications may be made thereunto without departing from the spirit and scope of the invention.

What is claimed is:

1. An attachment profile for the upper and/or lower termination of a stud wall erected in balloon frame construction, said attachment profile adapted to be placed on upper and/or lower front sides of approximately vertically erected stud profiles of the stud wall, said attachment profile comprising:

a profile web;

two side webs spaced apart from one another and connected to the profile web, so as to form a U-shaped attachment profile, the side webs lacking any cuts that extend through an entire height of the side webs;

wherein the profile web is notched so that fastening tabs are formed from the profile web, said fastening tabs being cut out of the profile web so that at least some of the cut edges of each of the fastening tabs are spaced apart from the remaining profile web, wherein the tabs are pivotable around a particular deflection edge connecting the side webs to the profile web, and wherein all fastening tabs of an attachment profile are pivotable around the same deflection edge.

2. The attachment profile according to claim 1, wherein a further cutout is incorporated into the profile web in a region of at least one of the fastening tabs, said further cutout running in at least approximately a right angle to a longitudinal extension of the attachment profile and extending at least up to an opposing deflection edge of the profile web.

3. The attachment profile according to claim 2, wherein the further cutout overlaps the deflection edge opposite to the fastening tabs so that the further cutout extends up into the side web adjoining said other deflection edge.

4. The attachment profile according to claim 1, wherein fastening holes are incorporated in at least some of the fastening tabs or the profile web.

5. The attachment profile according to claim 1, wherein the attachment profile is produced from a flat strip using a single stamping-shaping stroke.

6. The attachment profile according to claim 1, wherein the attachment profile is manufactured from a corrosion-protected steel plate or from plastic, in a cold rolling method.

7. A method for erecting a stud round wall using attachment profiles, each attachment profile comprising a profile web and two side webs spaced apart from one another and connected to the profile web so as to form a U-shaped attachment profile, the side webs lacking any cuts that extend through an entire height of the side webs, wherein the profile web is notched so that fastening tabs are formed from the profile web, all of said fastening tabs being cut out from the profile web and being pivotable around a same deflection edge connecting, one of the side webs to the profile web, the method comprising the following steps:

laying one of the attachment profiles that has been pre-bent by hand, on an erection base according to a predetermined course of a stud round wall, said attachment profile being connected to the erection base using fastening holes of the profile web, installing a further upper attachment profile, which is pre-bent according to a course of the stud round wall, on a ceiling structure, so that an open side of the U-shaped attachment profile is open downward toward the erection base, fixing the further upper attachment profile using the pivotable fastening tabs on an incline or other ceiling and/or ceiling structure, erecting stud profiles, by inserting front sides of the stud profiles into the open side of the U-shaped attachment profile, and fixing the stud profiles in this position, using crimping pliers, and fixing the stud profiles on the further upper attachment profile in a downwardly open side of the U-shaped further upper attachment profile, by engagement of the stud profiles with the upper attachment profile.

* * * * *